US005439643A

United States Patent [19]

Liebert

[11] Patent Number: 5,439,643

[45] Date of Patent: Aug. 8, 1995

[54] METHOD AND APPARATUS FOR TERMINAL STERILIZATION

[76] Inventor: Richard T. Liebert, 12 Kristen Dr., Ballston Spa, N.Y. 12020

[21] Appl. No.: 146,957

[22] Filed: Nov. 3, 1993

[51] Int. Cl.[6] ..... A61L 2/06; B01J 3/04

[52] U.S. Cl. ..... 422/25; 422/307; 422/302

[58] Field of Search ..... 422/25, 26, 295, 293, 422/294, 302, 805, 307

[56] References Cited

U.S. PATENT DOCUMENTS

| | | | |
|---|---|---|---|
| 3,086,837 | 4/1963 | Wilkinson et al. | 422/25 |
| 3,481,688 | 12/1969 | Craig et al. | 422/25 |
| 3,897,818 | 8/1975 | Champel | 422/25 X |
| 3,945,796 | 3/1976 | Nagamatsu et al. | 422/302 X |
| 4,225,555 | 9/1980 | Fahlvik et al. | 422/25 |
| 4,263,258 | 4/1981 | Kalasek | 422/26 X |
| 4,301,113 | 11/1981 | Alguire et al. | 422/295 X |
| 4,406,861 | 9/1983 | Beauvais et al. | 422/26 X |
| 4,576,792 | 3/1986 | Mårtensson | 422/26 X |
| 4,614,515 | 9/1986 | Tripp et al. | 604/403 |
| 4,718,463 | 1/1988 | Jurgens, Jr. et al. | 422/25 X |
| 4,834,717 | 5/1989 | Haber et al. | 604/193 |
| 5,044,141 | 9/1991 | Frachi | 422/294 X |
| 5,207,983 | 5/1993 | Liebert et al. | 422/25 |

*Primary Examiner*—Robert J. Warden
*Assistant Examiner*—E. Leigh Dawson
*Attorney, Agent, or Firm*—Schmeiser, Olsen & Watts

[57] ABSTRACT

An apparatus and method for terminal sterilization of prefilled packages is disclosed. A prefilled package such as syringe, vial, cartridge, or bottle is inserted into a sterilization chamber. The chamber is pressurized with a gas having a humidity between 0% to 100%. The gas is then heated such that the prefilled package does not fail and a vapor is generated within said prefilled package which is lethal to pathogens. The package is then cooled to drop the temperature of the prefilled package.

9 Claims, 7 Drawing Sheets

METHOD AND APPARATUS FOR TERMINAL STERILIZATION

FIELD OF THE INVENTION

The present invention describes a method and apparatus for terminal sterilization of pre-filled plastic and glass packaging containing pharmaceutical, biological, veterinary or food products. More specifically, the invention includes terminal sterilization of prefilled parenteral pharmaceutical products and packages. These products include, but are not limited to, prefilled syringes, prefilled cartridges, prefilled vials and prefilled bottles that are fabricated from glass, plastic, or other flexible packaging, such as thermoplastic elastomer.

BACKGROUND OF THE INVENTION

Prefilled packages such as parenteral products are terminally sterilized to reduce or eliminate the risk of exposing persons and animals to potential pathogens contained therein. The pharmaceutical industry, medical profession and Food and Drug Administration (FDA) have generally taken the position that terminal sterilization of prefilled packages can only be achieved (outside of radiation treatment such as Gamma, E-beam or ultraviolet) by steam sterilization. In steam sterilization, a steam autoclave is generally used in the preferred method.

The use dry heat at temperatures of 100° C. to >130° C. has been well documented (e.g., through testing done on pathogens such as *bacillus sterothermophilous*) as being unable to sterilize hard goods, packaging components and equipment such as parenteral manufacturing vessels. However, these documented tests are flawed in that they are not representative of actual sterilization. During these documented tests, the test micro organisms and/or pathogens were given direct exposure to the dry heat. In contrast, during actual steam sterilization procedures micro organisms and/or pathogens are not given direct exposure to dry heat, but are contained inside a prefilled package such as a syringe, vial, or cartridge. As the package is heated, the prefilled fluid or formulation inside the package vaporizes. This vapor produces a pressure and temperature which is lethal or cidal to pathogens. It has been the failure of the industry to understand this flaw in the understanding of the testing that has lead them to believe that a steam environment outside the prefilled package is a necessary requirement to produce the desired lethal or cidal effect on the pathogens inside the package.

The prior art discloses processes for producing parenteral products prefilled into sterile and non-sterile primary packages, then subjecting the prefilled packages to terminal sterilization by steam autoclaving with varying amounts of air over pressure used in conjunction with the steam. Prior to U.S. Pat. No. 4,718,463, to Jurgens et al. and U.S. Pat. No. 5,207,983, to Liebert et al., which are hereby incorporated by reference, the terminal sterilization of prefilled syringes and prefilled cartridges by steam autoclaving had not been successfully accomplished.

The patents to Jurgens et al. and Liebert et al. explored and addressed failures during sterilization by steam autoclaving of prefilled parenteral packages such as syringes and cartridges. These failures occurred for primarily four reasons:

First, the plunger would blow out due to an excessive pressure differential between the inside and outside of the barrel. During sterilization, a pressure differential would result from the combined vaporization of the formulation and expansion of the head space gas due to heat input, and insufficient pressure maintained outside the package in the sterilization vessel.

Second, the plunger would blow out due to inadequate allowances for plunger movement. During heating, a sufficient space must exist on the proximal side of the plunger to accommodate for expansion of the formulation and head space gas.

Third, the plunger may blow out due to a temporary low pressure spike during the cooling phase of the prefilled plastic syringes and cartridges. During cooling, the sterilization chamber pressure drops such that the pressure within the syringe is sufficiently higher than the chamber pressure. This pressure differential overcomes the frictional drag resistance between the plunger and the barrel thereby resulting in plunger movement and failure by the plunger blowing out the breech end of the barrel. This is a significant risk which was noted when using the method of Liebert et al., U.S. Pat. No. 5,207,983.

Fourth, the head space volume in the prefilled syringe or cartridge is too large causing a failure similar to inadequate reservations for plunger movement.

An understanding of the need to diminish the pressure differential between the chamber and the package interior was recognized by Jurgens et al., U.S. Pat. No. 4,718,463, which proposed maintenance of autoclave chamber pressure at least equal to the pressure inside the prefilled syringes. This condition, when all other aspects are under control, reduced the risk of plunger blow out.

Greater understanding of the relevant mechanisms for achieving successful terminal sterilization were demonstrated by Liebert et al., U.S. Pat. No. 5,207,983, by specifying an autoclave chamber pressure less than the pressure of the syringe contents. Additionally, the importance of head space volume and empty space at the proximal end of the barrel was also recognized and specified. Head space volume was specified as ≦10% by volume and empty space at the proximal end of the barrel, behind the plunger of 2% to 10%. Liebert et al. further identified the potential for terminal steam sterilization of glass syringes and cartridges that were not restricted by the amount of autoclave chamber over pressure as were the syringes and cartridges fabricated from plastic.

One of the drawbacks of the methods of the Jurgens et al. and Liebert et al. patents is the significant cost requirement. These methods require numerous mechanisms and conditions, such as a supply of Water For Injection, plant steam, stack water, a clean steam and its associated generator, a filtered air source and appropriate power feed, for operation of the steam autoclave. In addition to these mechanisms and conditions, the autoclave also required state of the art programmable control systems. The control systems must have the capability of purging residual air, accurately regulate heating rate based on load temperature, chamber pressure, temperature range during exposure, cooling rate, pressure ramp and air over pressure. Add to these requirements the hardware necessary, such as the jacketed vessel circulation pump(s), heat exchangers, process water and WFI plumbing, air lines, suitable waste water collection system and temperature monitoring equipment such as RTDs or thermocouples it is clear that a tremendous investment is necessary. While the present invention can be performed in an expensive autoclave chamber, it reduces the expense necessary by being usable in a much simpler and more economical chamber.

SUMMARY OF THE INVENTION

The present invention provides terminal sterilization of prefilled packaging such as syringes and cartridges, without expensive equipment such as the steam autoclave. It is possible to achieve the same level of confidence as in the prior art, that is, to accumulate the same number of $F_o$, with dry gaseous heat having a Relative Humidity of 0 to 100%. The present invention uses the formulation's vapor to produce the desired lethal or cidal effect.

Terminal sterilization of prefilled syringes and cartridges fabricated from plastic or glass, using the present invention, also require certain conditions for the package fill volume, head space and leeway at the breech end of the barrel for plunger movement during sterilization. Additionally adequate pressure must be maintained within the air sterilization vessel to prevent package failure due to plunger blow out.

In the case of prefilled flexible packaging, adequate pressure must also be maintained in the air sterilization vessel to prevent plastic deformation of the package resulting from the vapor pressure of the formulation when at sterilization temperatures.

Terminal sterilization of prefilled vials and bottles may be accomplished in a similar manner, except, these packages are more tolerant of greater pressure differentials. If these packages are sealed adequately, they may be terminally sterilized, using the current invention, with or without added pressure in the air sterilizing vessel.

The present invention offers an economical method for the terminal sterilization of prefilled aqueous-based pharmaceutical formulations and aqueous based medical products and its packaging which is equivalent to terminal steam sterilization in ability to destroy pathogens or micro-organisms. The current invention utilizes dry or humid heated gas to heat the prefilled packages and their contents. As heat is applied to the exterior of the package, the vapor pressure of the formulation contained within the prefilled package increases. Upon reaching its boiling point, vapor such as steam is generated by the formulation and the pressure within the package increases. Heating of the package and its contents may continue until a specific exposure temperature is reached. The vapor and pressure within the package are the specific components that result in lethal exposure to viable organisms. As further clarification, it is the formulation itself that generates the lethal steam and pressure, not the heating medium as was believed in the past.

Boiling point, vapor pressure and thermal expansion of different formulations will vary due to solute load and solvent combination. Given adequate head space, these aspects are of minor significance as they relate to prefilled vials and bottles, but, are very significant in their association with prefilled syringes, cartridges and flexible packaging. An adequate pressure must be maintained within the sterilization chamber to prevent package failure due to the pressure increase inside the package as the formulation is heated. Prefilled syringes, cartridges and flexible packaging must have adequate allowances for the thermal expansion of the formulation and head space gas to avoid loss of package integrity from plunger blow out or package rupture.

Specifically, for prefilled syringes and cartridges, the minimum amount of expansion space at the proximal end of the barrel is first dependent on the percentage of thermal expansion of the formulation when heated from ambient to the sterilization temperature. Additionally, the amount of head space gas within the prefilled syringe or cartridge will have a bearing on the required amount of barrel expansion space needed for plunger movement. It is important to minimize the head space gas bubble when possible such that its surface area is equal to or less than the surface area of the proximal side of the syringe or cartridge plunger. If the head space bubble has a surface area greater than the proximal side of the plunger, the pressure in the sterilization chamber must be increased and the amount of barrel expansion space on the proximal side of the plunger. The minimum pressure inside a prefilled syringe or cartridge at a given temperature and at equilibrium with its exterior environment will be equal to the vapor pressure of the formulation plus the contribution of the thermal expansion of an ideal gas plus an increase in pressure due to the frictional resistance between the plunger and the inside wall of the barrel and the contribution of the further compression of the head space bubble caused by the thermal expansion of the formulation. One of the above factors contributing to the pressure in the prefilled syringe or cartridge will be present regardless of plunger movement, the vapor pressure of the formulation. Therefore, minimum chamber pressure must be maintained at the vapor pressure of the formulation minus the apparent pressure reduction produced by the frictional drag between the plunger and barrel ID (inside diameter). The maximum pressure of the air sterilizing chamber is only limited by the upper pressure safety limit of the sterilizing chamber. In addition to the thermal expansion considerations, it is of critical importance that the materials of fabrication have adequate thermal stability such that the package will maintain dimensional integrity after the terminal sterilization is complete.

The prefilled flexible packaging considerations differ from the requirements of the prefilled syringes and cartridges. The flexible packaging which is hermetically sealed at ambient room temperature and pressure is sensitive to increases of internal pressure as occurs during terminal heat sterilization. This sensitivity to internal pressure increase can be partially addressed through the use of increased sterilization chamber pressure. Additional consideration must be given to the thermal expansion of the formulation contained within the flexible packaging. The thermal expansion of the product may be addressed by one of or a combination of the following:

First, the material of fabrication for the flexible package should have a modulus of elasticity at least high enough to expand with the formulation as it heats. It should then return to its original dimensions as the formulation cools and density increases. Second, an adequately portioned volume of gas within the sealed flexible package must be determined and present to diminish in volume as the formulation expands thermally. Finally, in addition to the thermal expansion considerations, it is of critical importance that the materials of fabrication have adequate thermal stability such that the package will maintain dimensional integrity after the terminal sterilization is complete.

In its simplest form, this invention may be employed by placing the prefilled packages in a pressure vessel fitted with heating elements or connected to a hot air source. Additionally, the vessel should have a means of circulating the air in the chamber to provide an even temperature distribution throughout the chamber. After loading the prefilled packages into the air sterilization vessel, the vessel is sealed shut, appropriate pressure is applied to the chamber to prevent package failure during the sterilization process. Next, the device for heating the air in the sterilization chamber is implemented. By monitoring the load and chamber temperature through the use appropriate temperature sensing devices such as RTDs, thermocouples or thermistors, the operator can determine when the load has had the necessary exposure (collected an adequate number of $F_o$ for the necessary reduction of the test organism used in validation). During the exposure, which is typically considered to be the dwell time of the load at or above 100° C., the formulation produces steam and pressure in response to the applied heat. When adequate exposure time has been attained, the applied heat may be discontinued so that the load can start to cool. To facilitate cooling, the air circulation device should continue to operate until the temperature of the load is low enough to assure maintenance of package integrity when the sterilization vessel is depressurized. The cooling of the load may be enhanced through the addition of a cooling or refrigeration coil. The coil may contain any material, liquid or gas that will function as a thermal sink and aid in the cooling of the load.

Under certain conditions the addition of water to the sterilization chamber is recommended. Water For Injection (WFI), purified water, potable water or water with specific solute loads may be used when the addition of water is necessary. The rationale for water or aqueous solutions is to raise the relative humidity in the sterilization vessel and thereby, reduce water vapor transmission rate (WVTR) through the prefilled package. Materials such as polymethylpentene and polycarbonate are known to have high water vapor transmission rates and would benefit from the higher relative humidity during terminal sterilization.

The air sterilization process may also be accomplished with more sophisticated vessels and accoutrements. To augment the heating or cooling of the chamber air and the load contained within it, the water or solution used for increasing relative humidity to reduce package WVTR, may be circulated from the same or an adjoining vessel fitted with heating and/or cooling capabilities. This cooling capability will reduce processing time and for this benefit, the increased cost of the chamber would be modest. In the closed system of the present invention, the only water introduced to the vessel and adjoining fitments would be the initial charge, therefore, no clean steam generator and no WFI generator expense is necessary. The added expense of a circulator pump and plumbing as well as a manner of heating and cooling the humectant would be necessary. Even with the added benefit of the more rapid heat exchange rate during heating and cooling of the chamber and load, maintenance of the sterilization chamber temperature and pressure is essentially performed by hot air. The necessary steam, temperature and pressure needed for cidal effects on the micro organisms is produced by the formulation inside the prefilled package.

DETAILED DESCRIPTION OF THE INVENTION

Terminal sterilization of prefilled pharmaceutical or other product packaging comprising the present invention will now hereinafter be described in detail.

Figure 1:
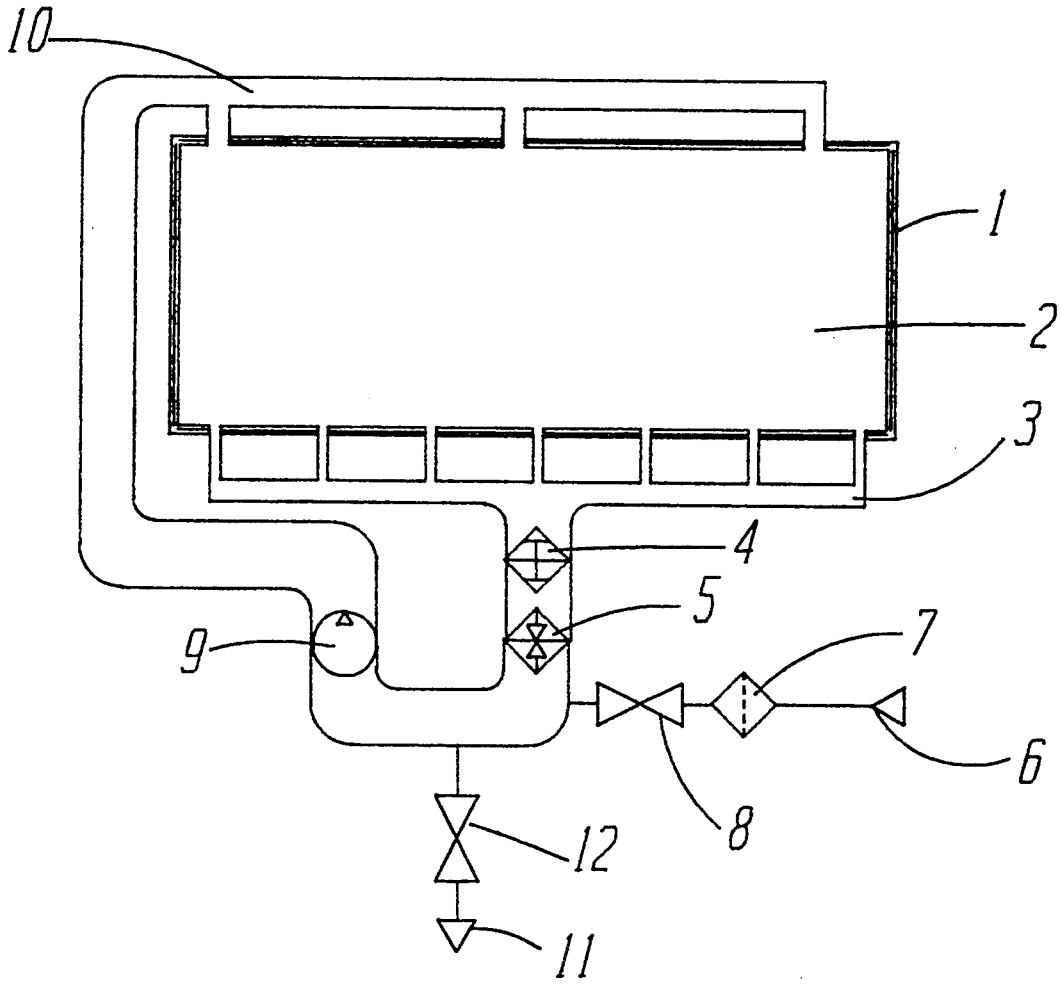
FIG. 1 is a sectional view of a basic air sterilization vessel and accoutrements of the present invention.

Terminal sterilization using the method of the present invention may be accomplished in sterilization apparatus as shown in FIG. 1. The vessel 1 of the apparatus may be of a hollow jacket design allowing a heating or cooling medium contact surface for aiding in temperature control of the chamber 2. Alternatively, the vessel 1 may be insulated to minimize the effect of ambient temperature outside the vessel 1 and the chamber 2. As the present invention depends on gas such as air or nitrogen as a heating and cooling medium, a multiplicity of chamber 2 inlets are provided in the form of a gas input manifold 3 to effect uniform heating of the chamber 2. Upstream from the input manifold 3 are a cooling device 4 and a heating device 5. The cooling device 4 may be in the form of a sealed refrigerant evaporator or other type of heat exchanger used for the purpose of removing heat. The heating device 5 may also be any of those commonly used for the purpose of imparting thermal energy such as an electric heating element or an appropriate heat exchanger. An air or gas input line 6 is provided for pressurizing the sterilization chamber 2 and pressure tight duct work after the aqueous product to be sterilized has been loaded into the chamber 2. The gas input line 6 includes an air filter 7 of appropriate porosity $\leqq 0.22$ micron and a gas input control valve 8. The gas (e.g air) in the pressurized closed system is circulated with a blower 9. A return manifold 10 is located upstream from the blower 9 and is in direct communication with the sterilization chamber 2. Multiple return ports are incorporated in the return manifold 10 to aid in even temperature distribution.

Sterilization of the product contained within the chamber 2 is accomplished by sealing the vessel 1 and then pressurizing the sealed system to a minimum pressure that will ensure the maintenance of package integrity when the formulation contained within the packages reaches sterilization temperature and the specific vapor pressure of the formulation at that temperature is achieved. The minimum pressure of the system will also be dependent upon the amount of head space gas within the package. The maximum chamber pressure is dependent upon the safe working limits of the sterilization vessel and accoutrements. The pressure of the system will naturally increase with temperature and will be directly proportional to the increase in temperature from the start of the cycle and that proportional increase as related to absolute zero. Once the system has been pressurized through the gas input line 6, the circulating blower 9 is started. Downstream from the blower 9, is the heating device 5 which adds thermal energy to the gas passing through and/or around it. The heated gas enters the sterilization chamber 2 by way of the input manifold 3. As the heated gas passes through the prefilled package load within the sterilization chamber 2, heat is transferred from the heating medium, (e.g. air) to the prefilled packages. The temperature of the load should be monitored through the use of appropriate temperature sensing devices such as thermocouples or RTDs which are in direct contact with the formulation contained within the prefilled packages. The heating device 5 should have some degree of controllability such that when the load reaches the desired sterilization temperature, the sterilization temperature can be maintained within reasonable limits for the prescribed dwell time. The heating medium is recycled from the chamber 2 through the gas return manifold 10 to the suction side of the blower 9.

When the prefilled package load has accumulated the prescribed assurance of sterility, the heating device 5 is discontinued and cooling commenced by starting the cooling device 4. The chamber 2 pressure will decrease initially in response to the temperature drop of an ideal gas and will stabilize upon reaching temperature equilibrium with the cooling device 4. Cycling the cooling medium, air or gas formerly the heating medium, should continue until the prefilled package contents reach a temperature low enough such that the vapor pressure of said contents is low enough that package integrity will be maintained when the system pressure is dropped to one atmosphere. When the prefilled package load temperature is adequately reduced, the circulator blower 9 may be shut down and the pressure in excess of one atmosphere may be vented through the air bleed line 11 by opening the air bleed valve 12.

Figure 2:
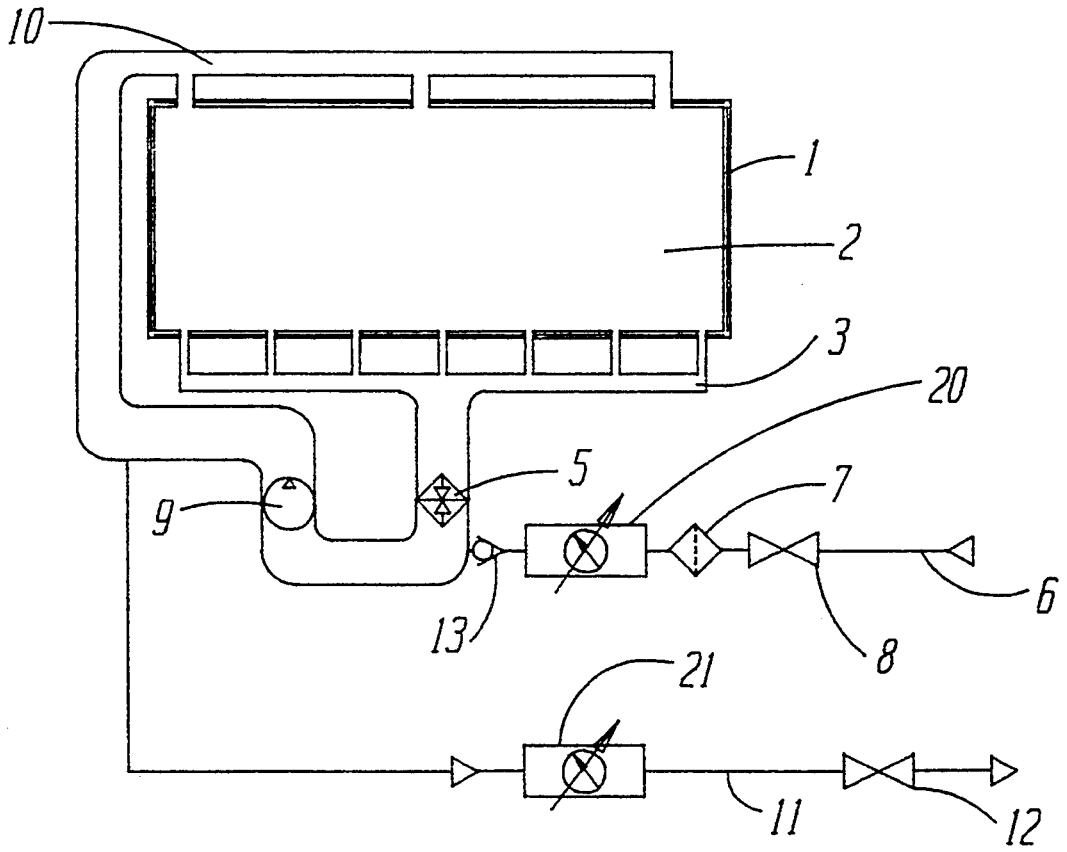
FIG. 2 is a sectional view of a variation of the first air sterilization vessel and its accoutrements of the present invention.

Reference is now made to FIG. 2. This chamber and system is similar to FIG. 1 except that the chamber and accoutrements of FIG. 2 use a different cooling device that requires only a filtered compressed air or gas source. The vessel 1 is fabricated as a jacketed or insulated receptacle for the chamber 2. Heating or cooling gas (heat transfer medium) is introduced to the chamber 2 through the input manifold 3. Thermal energy is added to the gas by way of a heating device 5 which may be any of those commonly used for the purpose of imparting thermal energy such as an electric heating element or an appropriate heat exchanger. The gas input line 6 incorporates an input control valve 8 and a sterilizing filter 7 of $\leqq 0.22$ micron. Additionally, the gas input line 6 incorporates a variable pressure regulator and gauge 20 and a check valve 13 to prevent reverse flow of chamber 2 air or gas into the input line 6. An air circulating blower 9 draws the heat transfer medium, air or gas, from the air return manifold 10 to recycle said heat transfer medium through the load contained in chamber 2. For cooling the load and venting excess pressure, the air bleed line 11 is employed. The air bleed line 11 is fitted with an air bleed valve 12 and a variable pressure regulator and valve 21.

After the chamber 2 has been loaded and the vessel 1 sealed, the system may be pressurized by opening the input control valve 8 and setting the pressure on the input variable pressure regulator and gauge 20 to allow sufficient gas pressure into the sealed system such that package integrity will be maintained throughout the terminal sterilization process. The circulating blower 9 is switched on and the heating device 5 activated. Heating of the load continues until the temperature of the formulation within the prefilled packages reaches the target exposure temperature. Upon reaching the exposure temperature, heat input from the heating device 5 is controlled to maintain said exposure temperature to accumulate the prescribed number of $F_o$ in the specific package/formulation combination making up the load.

When the cooling phase of a terminal sterilization cycle is initiated, the heating device 5 is switched off, inlet line 6 pressure is set on variable pressure regulator and gauge 20 at a value greater than the setting on the outlet line 11 variable pressure regulator and gauge 21. The pressure setting of the outlet line 11 variable pressure regulator and gauge 21 should be no lower than that which will assure maintenance of the prefilled package integrity. A flow meter (not shown) may be incorporated within the input line 6, the outlet line 11 or both to monitor the volume of heat exchange medium being put through the system. When the air input control valve 8 and the air bleed valve 12 are opened, cool gas such as air is introduced to the intake manifold 3 by way of the air input line 6. The rate at which the cooling gas is introduced to the system is dependent upon the pressure differential between the input variable regulator and gauge 20 and the bleed variable regulator and gauge 21 as well as the input line 6 and bleed line 11 sizes. The input rate of cooling gas should be less than the pumping rate of the circulating blower 9 such that all of said cooling air or gas is directed through the load contained in the sterilization chamber 2.

When the temperature of load (prefilled packages) contained within the sterilization chamber 2 reaches a safe temperature, typically $\leqq 100°$ C. the air input control valve 6 may be closed. The system will drop in pressure to reach equilibrium with that of the atmosphere outside.

Figure 3:
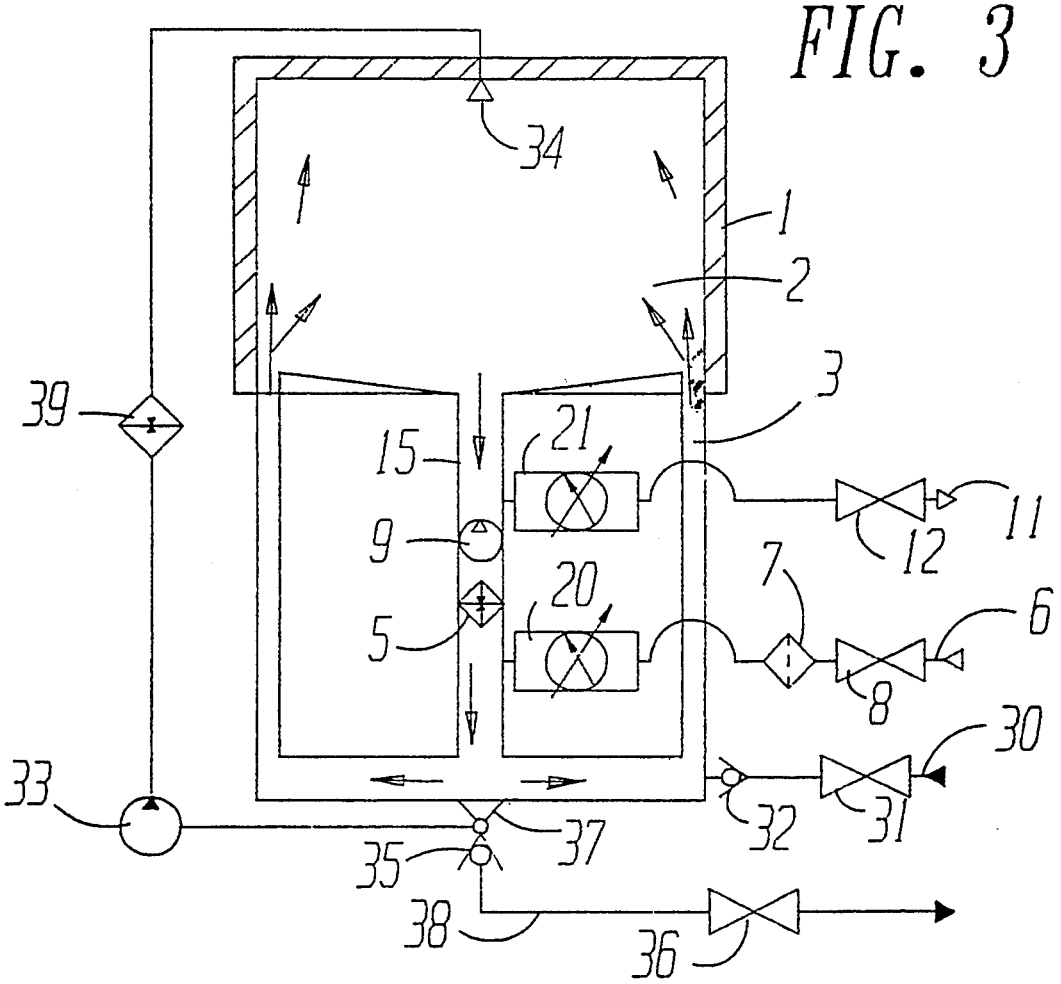
FIG. 3 is a sectional view of a more sophisticated air sterilization vessel and accoutrements of the present invention that enables the addition of water to enhance process capabilities.

Reference is now made to FIG. 3. The system represented by FIG. 3 introduces the use of water for the primary purpose of reducing water vapor transmission or weight loss from the prefilled packages. Some packaging materials such as polymethylpentene, polycarbonate, polyethyleneteraphthalate and some polyesters exhibit a relatively high water vapor transmission rate at room temperature which is exacerbated at the elevated temperatures of terminal sterilization. Most attributes of the present figure are the same as described in FIG. 1 and FIG. 2 except for the addition of the water related features. The addition of moisture to the terminal sterilization of the present invention expedites heating and cooling of the prefilled package load contained in the sterilization chamber 2. The sterilization vessel 1 includes an air input manifold 3, an air return manifold 15 and a water spray nozzle 34. The air input line 6 includes an air filter 7, an air input control valve 8 and a variable pressure regulator and gauge 20. The location of the air input line 6 is purposely located downstream from the air circulating blower 9 and the air bleed line 11 so that during the cooling phase of a terminal sterilization cycle, the input cool air will pass through the prefilled package load in the chamber 2 before reaching the air bleed line 11. As shown in the present figure, a heating device 5 is included downstream from the air circulation blower 9. The heating device 5 adds thermal energy to the circulating air and condensate water. The air bleed line 11 consists of an air bleed valve 12 and a variable pressure regulator and gauge 21. The water input line 30 consists of a water input valve 31 and a check valve 32 at the system junction to eliminate a dead leg as a source of microbial contamination. Water is drained from the system through a water drain line 38 that connects to the water drain and circulation sump 37. Also included in the drain line 38 is a water drain valve 36 and a check valve 35 located at the connection with the sump 37. Water in this system is circulated by way of a water circulating pump 33. A water heating device 39 is necessary to prevent cooling of the load as the pressurized water emerging from the water spray nozzle(s) 34 is an endothermic process.

Running a terminal sterilization cycle in a system conforming to that shown in FIG. 3 includes numerous similarities to the cycle described above for FIG. 2. After the chamber 2 of FIG. 3 has been loaded and the vessel 1 sealed, the system is filled with the appropriate volume of water for injection through the water input line 30 by opening the water input valve 31, the water input valve 31 is closed after filling. The water input check valve 32 prevents reverse flow of water from the system and eliminates a dead leg. The system is then pressurized by opening the input control valve 8 and setting the pressure on the input variable pressure regulator and gauge 20 to allow sufficient air or gas pressure into the sealed system such that package integrity will be maintained throughout the terminal sterilization process. The air circulating blower 9 is switched on, the heating device 5 activated as is the water circulating pump 33 and the water heating device 39. A combination of circulating hot air and hot water sprayed from water spray nozzle(s) 34 imparts its thermal energy to the load contained in the sterilization chamber 2. Heating of the load continues until the temperature of the formulation within the prefilled packages reaches the target exposure temperature. Upon reaching the exposure temperature, heat input from the heating device 5 and water heating device 39 is controlled to maintain said exposure temperature for the purpose of accumulating the prescribed number of $F_o$ in the specific package/formulation combination making up the load.

When the cooling phase of a terminal sterilization cycle is initiated, the heating device 5 and the water heating device 39 are switched off, inlet line 6 pressure is set on variable pressure regulator and gauge 20 at a value greater than the setting on the outlet line 11 variable pressure regulator and gauge 21. The pressure setting of the outlet line 11 variable pressure regulator and gauge 21 should be no lower than that which will assure maintenance of the prefilled package integrity. A flow meter (not shown) may be incorporated within the input line 6, the outlet line 11 or both to monitor the volume of heat exchange medium being put through the system. When the air input control valve 8 and the air bleed valve 12 are opened, cool air or gas is introduced to the intake manifold 3 by way of the air input line 6. The rate at which the cooling air or gas is introduced to the system is dependent upon the pressure differential between the input variable regulator and gauge 20 and the bleed variable regulator and gauge 21 as well as the input line 6 and bleed line 11 sizes. The water circulating pump 33 may be left running while the load cools for continued reduction of water vapor transmission through the package walls and to aid in cooling. The input rate of cooling air or gas should be less than the pumping rate of the air circulating blower 9 such that all of said cooling air or gas is directed through the load contained in the sterilization chamber 2.

When the temperature of load (prefilled packages) contained within the sterilization chamber 2 reaches a safe temperature, typically $\leqq 100°$ C. the water circulating pump 33 is turned off, the water drain valve 36 is opened and the air input control valve is closed. Residual pressure in the system forces the water out through the water drain sump 37 and into the water drain line 38. The system will drop in pressure to reach equilibrium with that of the atmosphere outside.

In the event a WFI or PW (purified water) system is not present at the location of the air sterilizer of FIG. 3, the water input line 30 and its accoutrements are eliminated and the system is manually filled with water of appropriate quality prior to sealing the sterilization vessel 1. The remainder of the cycle is consistent with that described above.

Figure 4:
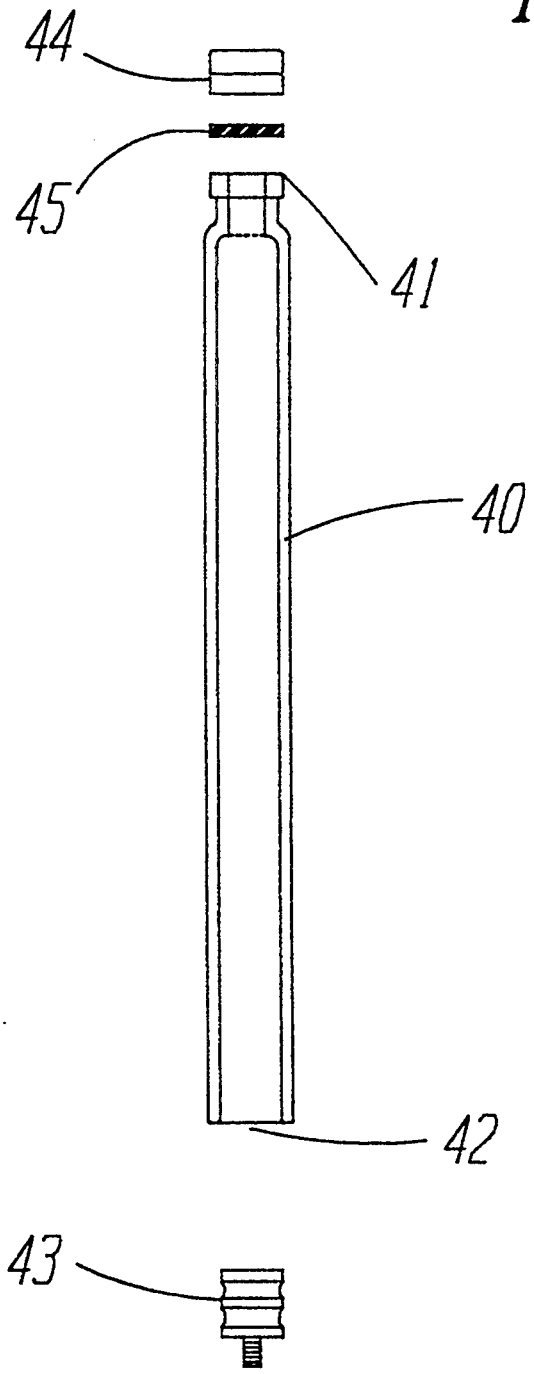
FIG. 4 is a side view of the components that comprise a typical prefilled syringe cartridge of the present invention.

Reference is made to FIG. 4 which is a component drawing of a typical syringe cartridge. The cartridge 40 is fabricated from glass or plastic. When plastic or thermoplastic elastomer is used, the prefilled cartridge 40 is a flexible walled container having a modulus that allows said flexible walled container to maintain its dimensional integrity after the expansion and contraction of the formulation that occurs during terminal sterilization. The tooled end of the cartridge 41 is configured to accept the seal 44 and deformable elastomer stopper or plastic disk 45. The breech end of the cartridge 42 accepts the plunger 43 for insertion to an appropriate location depth inside the cartridge 40. Preparation for assembly and filling of the cartridge 40 and ancillary components requires that all of the formulation contacting surfaces be clean, sterile and pyrogen free or a similar equivalent through the demonstration of pyrogen load reduction. Additionally, the plunger 43 and/or the cartridge 40 interior may be siliconized to facilitate functionality. After completing the appropriate preparation of the components, the plunger 43 is inserted into the cartridge 40 through the breech opening 42. The placement position of the plunger 43 in the cartridge 40 requires that adequate expansion room be left at the proximal end of said cartridge 40 to accommodate the thermal expansion of the formulation and head space bubble without exposing either void area between the plunger 43 rings or blowing out said plunger 43. The cartridge 40 is filled with formulation through the opening in the tooled end 41. The seal 44 and the deformable disk 45 are applied to the tooled end 41 of the cartridge 40 as an assembly, then crimped in place.

Figure 5:
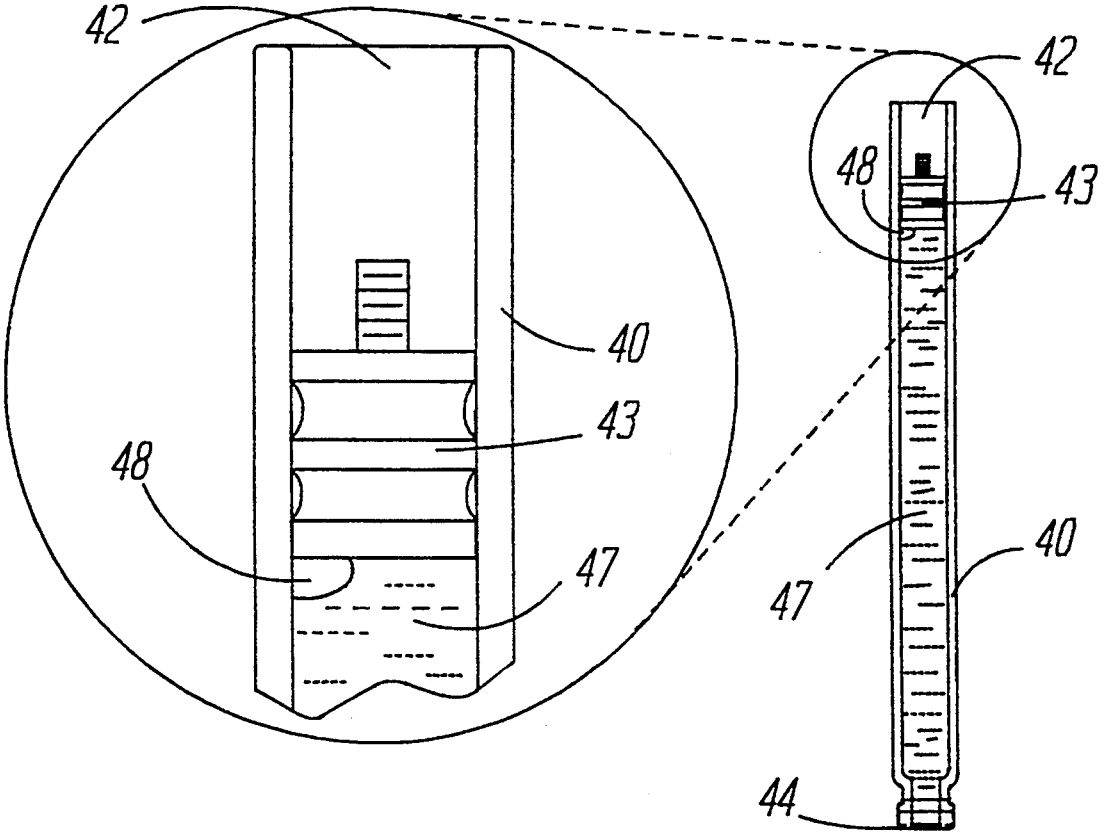
FIG. 5 is a side view of an assembled and filled syringe cartridge of the present invention including a magnification window to demonstrate more detail.

Referring to FIG. 5, showing a side view of an assembled and filled syringe cartridge which includes a magnification window that demonstrates the head space bubble. The inverted cartridge 40 is sealed at the distal tip with the seal assembly 44 and is filled with formulation 47. The formulation may be imaging agent, medicament, biological, analgesic, veterinary, food, etc. The plunger 43 previously inserted into the breech 42 of the cartridge 40 far enough to accommodate the thermal expansion of the formulation 47 and the head space bubble 48 during terminal sterilization. Thermal expansion of the formulation is dependent on its composition. If the formulation 47 uses only water as a solvent, thermal expansion will be dependent on the solute load. If the formulation 47 employs multiple solvents, thermal expansion will be dependent on said solvents and the solute load. Ideally, the head space gas bubble 48 should be minimized as demonstrated in the magnification window. Preferably, the surface area of the head space bubble 48 should be less than the surface area of the proximal side of the plunger 43. As the head space bubble 48 increases in volume, the amount of expansion space at the breech 42 of the cartridge 40 also must increases, therefore, reducing the potential formulation 47 fill. Other conditions that are important to successful terminal sterilization are sufficient lubricity of the plunger 43 with the inside of the cartridge 40 and avoiding contamination of the plunger 43 rings and void areas with formulation. Failure to address the lubricity and contamination could result in explosive plunger movement when the bond between said plunger 43 and the cartridge 40 breaks effecting blowout.

The amount of chamber pressure necessary for successful terminal sterilization is dependent upon the formulation 47 fill volume and vapor pressure of said formulation 47, the head space volume 48, the amount of expansion space at the breech 42, the amount of dissolved gas in the formulation and the amount of frictional drag between the inside of the cartridge 40 and the plunger 43. If the package has little or no head space bubble 48 and adequate allowance for the thermal expansion of the formulation 47, a pressure at least equal to the vapor pressure of said formulation 47 at exposure temperature will result in successful terminal sterilization. Chamber pressure greater than the sum of the formulation 47 vapor pressure and the pressure contribution of the head space bubble at the exposure temperature further reduce the risk of package failure during sterilization. If the surface area of the head space bubble 48 is equal to or greater than the surface area of the proximal side of the plunger 43, increased chamber pressure and greater expansion space on the proximal side of said plunger 43 is indicated.

The most relevant aspects influencing the pressure generation during the sterilization process can be described by illustration. Pressure within a prefilled syringe or cartridge at exposure temperature having the following conditions is presented:

$P_a$=Pressure ambient=14.69 psia (0 psig)

$T_a$=Temperature ambient=298° K. (25° C.)

Head space volume remains constant

Formulation composition—Water For Injection (WFI)

Dissolved gas—negligible, remains approximately constant at elevated temperatures while under pressure (air=0.020 parts by volume at 20° C. and 1 atmosphere pressure).

$T_s$=Sterilization temperature=394.5° K. (121.5° C.)

$VP_{WFI}$=Vapor pressure of WFI at 121.5° C.=29.89 psia (15.2 psig)

$273_o$K.+25=Ambient temperature in ° Kelvin $P_s$=psi increase resulting from heating an ideal gas to 121.5° C.

$P_a[(T_s-T_a)/298]=P_s=14.69(0.3238)=4.76$ psia pressure increase due to the pressure contribution of an heating ideal gas.

Total pressure at sterilization temperature within the syringe or cartridge equals the sum of the pressure of an ideal gas heated to the sterilization temperature (14.69 psia+4.76 psia=19.45 psia) and the $VP_{WFI}$ at the sterilization temperature (head space volume remaining constant).

$$VP_{WFI}+P_a+P_s=\text{Total pressure},$$

$$29.89+14.69+4.76=49.34 \text{ psia or } 34.65 \text{ psig}.$$

In most instances, the terminal sterilization of prefilled packages would employ chamber pressures well in excess of that generated with said prefilled packages. However there are occasions when reduced pressure may be necessary. The appropriate explanation is warranted for the mechanism that allows terminal heat sterilization of a prefilled syringe or cartridge using pressure equal to or even slightly below the vapor pressure of the formulation. This pressure relationship between chamber and prefilled package obviously results in higher risk of package failure, but, terminal sterilization can be accomplished with due diligence. Under the conditions of equal pressure, or pressure slightly less than the formulation vapor pressure, it is absolutely critical that there be very little or no head space bubble. The equal pressure illustration allows the plunger to move in response to the expanding formulation only, but prevents the plunger from sliding out of the proximal end of the syringe or cartridge. The example of sterilization chamber pressure slightly less than the formulation vapor pressure is dependent on both the pressure that is in the chamber and the frictional drag that exists between the plunger and barrel or cartridge interior surface to prevent plunger blow out.

Figure 6A:
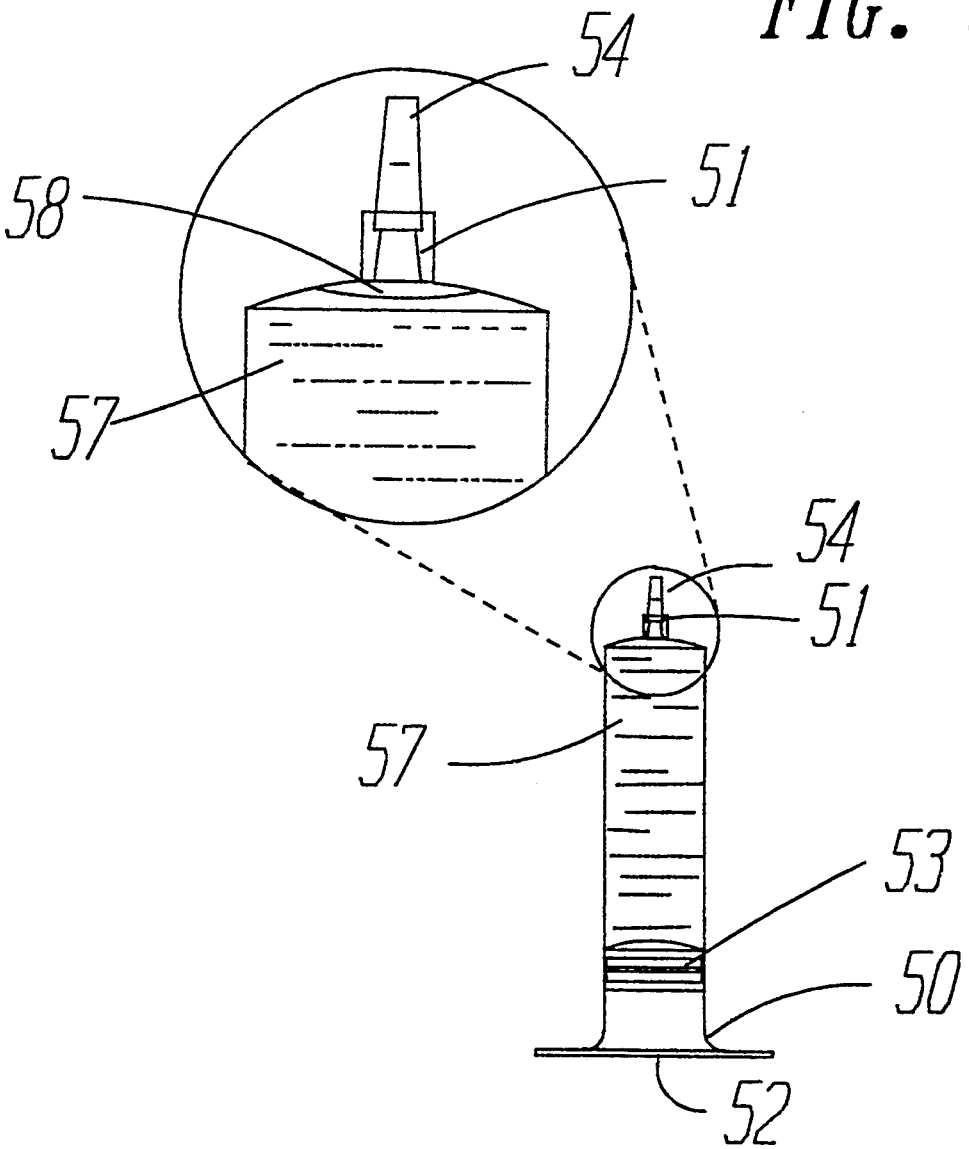
FIGS. 6*a* and 6*b* show side views and magnification windows of both a prefilled hand held syringe and the likeness of a power injector cartridge.
Figure 6B:
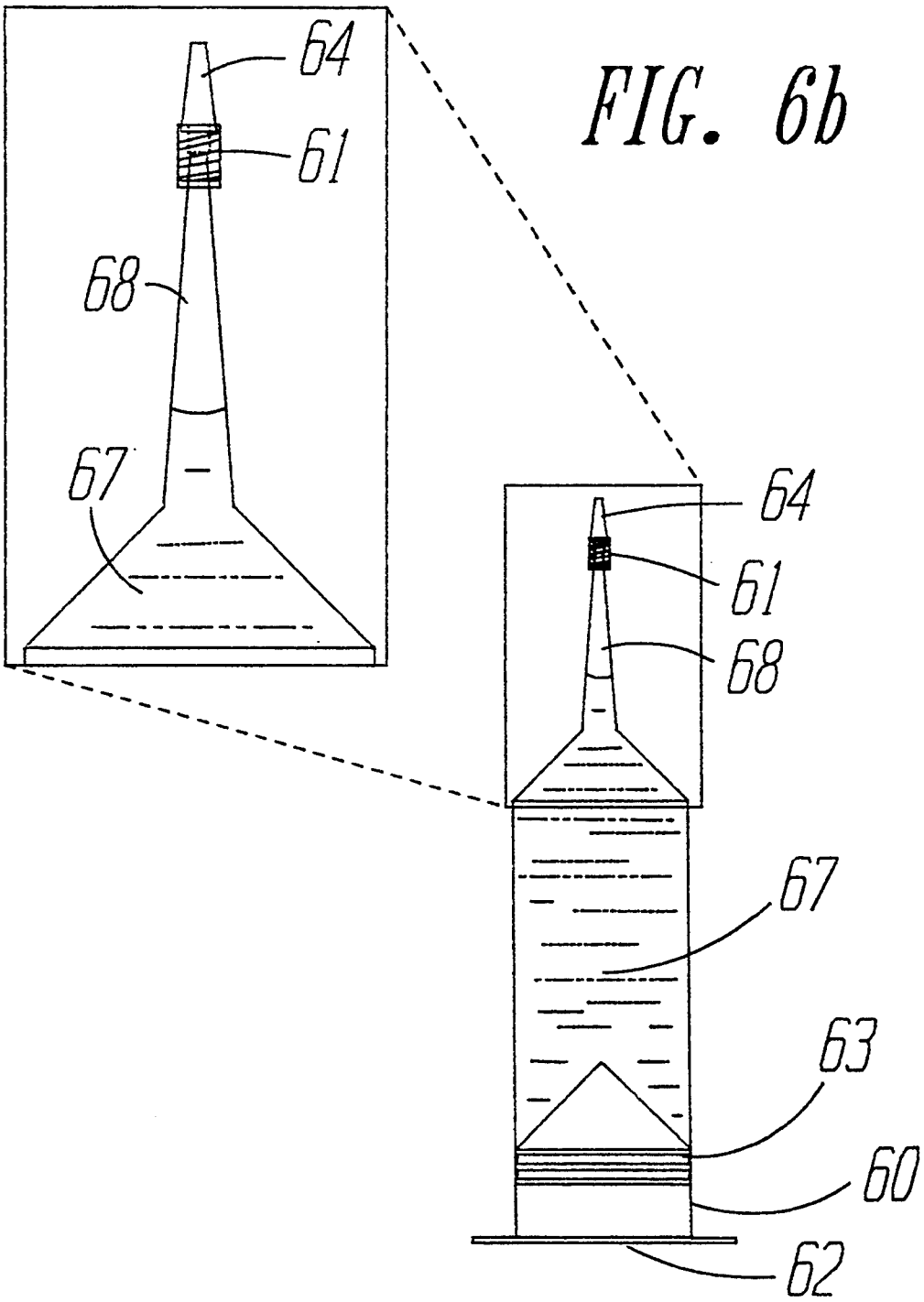

Reference is now made to FIGS. 6*a* and 6*b* showing side views and magnification windows of both a prefilled hand held syringe and a power injector cartridge. The typical material of fabrication for the barrel 50 and 60 of each is a heat resistant plastic. Both packages may be filled through either the distal or the proximal end. FIG. 6*a* depicts the hand held syringe is identified by components 50 through 58. FIG. 6*b* represents the power injector cartridge distinguished by elements 60 through 68. The distal end of the hand held syringe barrel 50 incorporates a Luer taper 51 for the purpose of interfacing with a hypodermic needle or a related medical device such as a butterfly. The Luer taper 51 opening is sealed with a tip cap 54 preferably fabricated from an elastomeric material able to maintain seal integrity during sterilization. The tip cap 54 may also be a plug or molded break off tip. The head space bubble 58 is shown in the magnification window above the formulation 57. The plunger 53 is shown recessed toward the distal end of the syringe to allow adequate expansion space of the syringe contents toward the breech 52 during the terminal sterilization. The plunger 53 should incorporate at least three sealing rings and two void areas between rings. The plunger 53 is preferably fabricated from an elastomeric material located within the barrel so as to seal the proximal end of the barrel to prevent leakage of the formulation.

The prefilled power injector cartridge is comprised of a barrel 60 that is fabricated such that its exterior conforms closely to the interior dimensions of the pressure jacket portion of a power injector machine. The interlock connection 61 is constructed such that a pressure tight seal may be achieved with ancillary medical devices needed for injecting the formulation 67. The breech end of the injector cartridge 62 is sealed with a plunger 63 that is typically comprised of two major components, an elastomer shell and a rigid interior. The plunger 63 should incorporate at least three sealing rings and two void areas between rings. The plunger 63 may include appendages designed to interlock with the drive mechanism of the power injector machine. The location of the plunger 63, as with the other examples cited, is recessed inside the breech end of the power injector cartridge 62 far enough to allow for the thermal expansion of the cartridge 60 contents without exposing or diminishing seal integrity of said plunger 63 with said cartridge 60. The distal end of the cartridge 60 is sealed with a tip cap 64 that is typically fabricated from an elastomeric material that is capable of maintaining seal integrity during terminal sterilization and is compatible with the formulation 67. The head space bubble 68 is shown in the magnification window. The head space bubble 68 location is immediately above the formulation 67.

Achieving an acceptable head space bubble 58 and 68 volume in each of these packages is significantly easier than with the cartridge shown in FIG. 4 and FIG. 5 as the fill volume and package size are much greater in the packages depicted in FIGS. *6a* and *6b*. While eliminating, or, minimizing the head space bubble 58 and 68 is also crucial and should be targeted with the hand held syringe and power injector cartridge there is a greater tolerance for its presence during this terminal sterilization process in these packages. The fill volume of hand held syringe barrel 50 and the power injector cartridge 60 will range from 10 cc to 200 cc or greater. A small head space bubble 58 and 68 of 1 cc, as an example, would require very little movement of the plunger 53 and 63, 0.324 cc displacement as derived from the thermal expansion of an ideal gas heated from 25° C. to 121.5° C., to offset the pressure increase in the prefilled package at sterilization temperature, attributable to increasing temperature of an ideal gas, the head space bubble 58 and 68. Because of the larger fill capacity of these packages, a proportionally smaller allocation of the package is necessary for accommodating the thermal expansion of the head space gas.

During the terminal heat sterilization of the prefilled syringes and cartridges, the formulation 57 and 67 contained within these packages will expand with increasing temperature. The plunger 53 and 63 will recede toward the proximal end of the barrel 50 or cartridge 60 in response to the expanding formulation 57 and 67. In a sealed sterilization chamber, the pressure of the heat exchange medium (e.g. air) will increase with temperature proportionally with respect to absolute zero above the original pressurization setting. Unless restricted by package needs, the initial system pressurization should be at least equal to the sum of the partial pressures of the head space bubble 58 and 68 and the formulation 57 and 67 vapor pressure within the prefilled package at the exposure temperature. This pressure setting is necessary to prevent plunger blow out when the cooling phase of the cycle begins and the pressure of the heat exchange medium drops in response to lowering temperature. If the head space bubble 58 and 68 is controlled during filling, the plunger 53 and 63 should recede toward the proximal end a distance equal to the sum of added formulation displacement at the exposure temperature plus approximate volume of the head space bubble 58 and 68. Specific plunger 53 and 63 movement is dependent upon initial chamber pressure head space volume and degree of lubricity between said plunger 53 and 63 and the barrel 50 or cartridge 60 wall. When the sterilization exposure temperature of the formulation 57 and 67 is reached, the status of the package and contents is maintained until the cooling phase starts. When the formulation 57 and 67 starts to cool, its density starts to increase and vapor pressure drops. When the pressure differential between the sterilization chamber and the package contents is great enough to overcome the frictional drag between the plunger 53 and 63 and the barrel 50 or cartridge 60 wall, the plunger starts to move toward the distal end of the package. When the temperature of the formulation 57 and 67 within the prefilled packages drops sufficiently, $<100°$ C., such that the risk of package failure is eliminated, the plunger 53 and 63 will be located approximately in the position occupied immediately before terminal sterilization. At this point, the over pressure may be vented and the load removed from the sterilization chamber.

Terminal sterilization of the syringe and cartridge using chamber pressure equal to the formulation vapor pressure at sterilization temperature is facilitated by the increased surface area of the proximal side of the plunger 53 and 63. Under equal or slightly below vapor pressure conditions, it is imperative that the head space volume be minimized or eliminated. During terminal sterilization of a prefilled hand held syringe or a prefilled power injector cartridge in an equal pressure environment, plunger movement is limited to accommodating the thermal expansion of the formulation 57 and 67 and offsetting the pressure increase of the head space bubble 58 and 68. Employing pressure conditions slightly below formulation vapor pressure at sterilization temperature can be accomplished through innovative plunger design that can actually increase the frictional drag between the plunger 53 and 63 and the barrel 50 or cartridge 60 interior. An example of a plunger design that increases apparent interference and therefore frictional drag between the plunger and the barrel is demonstrated by incorporating an unsupported radius on the front face of plunger. When the pressure within the syringe increase in response to thermal expansion of the product and elevated vapor pressure the above mentioned plunger face is urged toward the proximal end of the barrel. The flattening of the plunger face results in increased interference at the outside diameter of the distal ring as the radius length of the plunger face increases.

In an alternate embodiment, the prefilled package may be a vial or bottle fabricated from plastic or glass. The vial or bottle would include an elastically deformable stopper at its opening, a crimp or snap on seal which retains said stopper during storage and conditions of elevated internal pressure as occurs during terminal sterilization, and a formulation fill in said vial or bottle that allows sufficient head space gas volume to accommodate the thermal expansion of said formulation and limit the maximum pressure of said head space to below the failure pressure of said stopper and seal.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. A method-for terminal sterilization of prefilled packages comprising:

providing a super-atmospheric pressure and temperature sterilization chamber, wherein said chamber includes temperature sensing devices for monitoring a temperature of a formulation within a pre-filled package;

inserting at least one package, having a formulation pre-filled therein, into said super-atmospheric pressure and temperature sterilization chamber;

providing a non-steam gas, having a humidity of 0 to 100%, within said sterilization chamber;

heating said gas and increasing the pressure of said gas to super-atmospheric pressure; and cooling said gas, wherein said heating and cooling steps further include: regulating and monitoring at least one of the pressure and temperature of said gas such that said prefilled package does not fail and monitoring at least one of said temperature sensing devices until the calculation of an adequate $F_0$ value has been indicated, such that a vapor is generated within said prefilled package which provides the necessary lethal reduction in pathogens and microorganisms.

2. The method for terminal sterilization of prefilled packages of claim 1, further comprising:

prefilling a syringe, cartridge, vial, or bottle as said pre-filled package.

3. The method for terminal sterilization of prefilled packages of claim 1, wherein the step of regulating further comprises:

injecting said gas through a gas inlet to increase the pressure;

heating the gas to provide an even heat distribution to produce said lethal vapor;

after an appropriate time has elapsed to kill said pathogens and microorganisms, cooling said prefilled package to lower the temperature therein; and venting said gas through an outlet to lower the pressure.

4. The method for terminal sterilization of pre-filled packages of claim 3, wherein the steps of heating and cooling further comprise:

spraying a liquid on said prefilled package; and circulating said liquid which has been sprayed on said prefilled package.

5. The method for terminal sterilization of pre-filled packages of claim 3, wherein the step of injecting said gas further comprises:

filtering said gas.

6. The method according to claim 1, wherein the step of regulating the pressure in the sterilization chamber further comprises:

maintaining the pressure at least equal to the sum of the partial pressures of the constituents within the prefilled package minus the apparent pressure decrease resulting from frictional drag of a plunger of said prefilled package with the inside of a barrel of said prefilled package.

7. The method according to claim 6, wherein the prefilled package comprises:

a plastic or glass cylindrical barrel having a first end with a fluid-tight tip thereon; and an elastomeric slidable plunger located within the barrel so as to seal the other end of said barrel to prevent leakage of a formulation contained therein.

8. The method according to claim 1, wherein the prefilled package comprises:

an elastically deformable stopper at its opening;

a seal positioned to retain said stopper during storage and conditions of elevated internal pressure as occurs during terminal sterilization, a head space gas within said prefilled package adapted to accommodate the thermal expansion of said formulation and limit the maximum pressure of said head space to below the failure pressure of said stopper and seal.

9. The method according to claim 1, wherein the prefilled package is a flexible walled container having a modulus of elasticity that allows said flexible walled container to maintain its dimensional integrity after the expansion and contraction that occurs during terminal sterilization.

* * * * *